US006407016B1

(12) United States Patent
Van Steenlandt et al.

(10) Patent No.: US 6,407,016 B1
(45) Date of Patent: Jun. 18, 2002

(54) REINFORCED KNITTED STRUCTURE COMPRISING METAL FIBERS

(75) Inventors: Wim Van Steenlandt, Sint-Niklaas; Guido Heirbaut, Temse, both of (BE)

(73) Assignee: N.V. Bekaert S.A., Zwevegem (BE)

( * ) Notice: Subject to any disclaimer, the term of this patent is extended or adjusted under 35 U.S.C. 154(b) by 0 days.

(21) Appl. No.: 09/462,777

(22) PCT Filed: Jul. 8, 1998

(86) PCT No.: PCT/BE98/00105

§ 371 (c)(1),
(2), (4) Date: Mar. 14, 2000

(87) PCT Pub. No.: WO99/04078

PCT Pub. Date: Jan. 28, 1999

(30) Foreign Application Priority Data

Jul. 14, 1997 (BE) ..... 9700614

(51) Int. Cl.[7] ..... D04B 1/00; D04B 11/10; D04B 7/14; D04B 9/16; B32B 15/14

(52) U.S. Cl. ..... 442/313; 442/304; 442/308; 442/316; 66/202

(58) Field of Search ..... 442/316, 304, 442/308, 313; 66/202

(56) References Cited

U.S. PATENT DOCUMENTS

| | | | | |
|---|---|---|---|---|
| 3,379,000 A | | 4/1968 | Webber et al. | 57/139 |
| 3,424,220 A | | 1/1969 | Schuerch | 152/358 |
| 4,930,199 A | | 6/1990 | Yanagisawa | 29/4.51 |
| 5,230,226 A | | 7/1993 | Saarikettu | 66/202 |
| 5,834,382 A | * | 11/1998 | Frebourg et al. | 442/320 |

FOREIGN PATENT DOCUMENTS

| | | | |
|---|---|---|---|
| BE | 97-08108 A | * | 3/1997 |
| WO | 94/01373 | | 1/1994 |
| WO | 97/04152 | | 2/1997 |

* cited by examiner

*Primary Examiner*—Terrel Morris
*Assistant Examiner*—Norca L. Torres
(74) *Attorney, Agent, or Firm*—Foley & Lardner

(57) ABSTRACT

The invention relates to a single-bed weft-knitted textile structure comprising stainless steel fibre bundles, in which a reinforcing multifilament insert yarn with a titre of less than 180 Tex is incorporated with tuck stitches into the textile structure in a regular pattern. The insert yarn is, for example, a multifilament stainless steel yarn, or a multifilament glass fibre yarn. In addition, the invention relates to the use of such a textile structure for covering moulds and tempering or press rings which are utilized in the process of forming glass plates, or for the covering of transportation means for glass plates during their forming process.

12 Claims, No Drawings

REINFORCED KNITTED STRUCTURE COMPRISING METAL FIBERS

The invention relates to a knitted textile structure comprising metal fibre bundles and into which a reinforcing multifilament insert yarn is incorporated.

Knitted structures comprising metal fibre bundles are described in the PCT patent application WO 97/04152 of the applicant and are being utilized in various fields of application.

These knitted fabrics are fairly heavy as a result of the high specific gravity of the stainless steel fibres of which they are constructed. This is certainly the case when the knitted fabrics are reinforced with an insert yarn which is of the same type as the knitted yarn. The high own weight of these knitted fabrics themselves can result in a certain sagging down when they are used as a covering for various supports. This means that the knitted fabrics do not always remain in an equally close fitting position to the contact-forming (more or less horizontal) supports. For certain applications, this constitutes a significant drawback.

Incorporating a conventional, relatively thick insert yam necessarily results in a knitted fabric with relatively large stitches. For many applications, however, there is a need for a knitted structure with small stitches and reinforced with an insert. But this requires high gauges during knitting, which is not possible if a conventional insert yam is incorporated into the knitted structure. Moreover, during the production of such a reinforced knitted fabric there is a real possibility of knitting defects and damage to the knitting machine.

It is an object of the invention to provide a reinforced, relatively light and thin knitted textile structure that comprises metal fibre bundles and that manages to avoid the drawbacks of the conventionally reinforced metal knitted fabrics described above.

In particular, the invention provides for a single-bed weft-knitted textile comprising stainless steel fibre bundles in which a reinforcing multifilament insert yarn with a titre of less than 180 Tex is incorporated into the textile structure in a regular pattern, e.g. by means of tuck stitches.

The metal fibres (e.g., made of a type of steel from the AISI 300 or 400 series, Fecralloy®, Aluchrome® or Nicralloy® which are used in the textile structure according to the invention can be obtained by shaving the edge of a roll of foil as described in U.S. pat. No. 4,930,199, or by means of the technique of bundled drawing, such as described for example in U.S. Pat. No. 3,379,000. The metal fibres have an equivalent diameter which is understood to be between 2 and 100 $\mu$m, and by preference between 2 and 40 $\mu$m. The equivalent diameter is defined here as the diameter surface area as that of the actual fibre in question.

The multifilament insert yam that is incorporated into the knitted textile structure according to the invention can be a multifilament metal or glass yarn consisting of between 30 and 1500 filaments.

Thus, for example, the insert yarn can be Bekinox® VN continuous yarn, which is composed of between 70 and 300 stainless steel filaments having an equivalent diameter of between 2 and 30 $\mu$m. The portion by weight of the insert in the textile structure is typically less than 35%.

In another embodiment, a multifilament glass fibre insert yam can be incorporated into the textile structure which, for example, is composed of E- or C-type glass fibres with a diameter of between 7 and 9 $\mu$m. On average, such glass yams comprise from 30 to 150 filaments. Thus there is a multifilament glass fibre yarn consisting, for example, of 2 single yarns, each containing 22 C-glass filaments that have a diameter of 7 $\mu$m and are twisted around one another. The portion by weight of the insert yarn in the textile structure is less than 25%.

The previously mentioned problem of sagging of the textile structure is thus solved by the use of a relatively light insert yarn, which results in a knitted fabric that is lighter in weight and which limits the elasticity of the textile structure in the weft direction. This is a very favourable factor for many applications, including the use of the textile structure as a covering for support structures that are used in the process of shaping or forming glass plates, such as car windows, as will be explained below.

Moreover, a multifilament insert yarn is stronger that a conventional spun insert yarn of the same thickness, so that with a thinner insert yarn a knitted fabric can be obtained which is at least equally strong.

In addition, a thinner insert yarn hinders the stitch formation process to a lesser extent so that with the same gauges a finer knitted fabric (with smaller stitches) can be obtained as compared to the corresponding conventional reinforced product. Moreover, a thinner insert yarn (with tuck stitches) makes it possible to produce reinforced Knitted fabrics with higher gauges than is conventionally possible.

The weft-knitted structure according to the invention is either flat or circularly knitted and is flexible. The textile structure has a weight which is between 600 and 2000 g/m$^2$. Its air permeability is more than 400 L/dm$^2$/min with a pressure drop of 100 Pa.

EXAMPLE

Weft-knitted textile structure as a covering support for moulding elements that are in contact with glass plates during the moulding process.

Great numbers of glass fibre fabrics are conventionally used in the manufacture and moulding of car windows, for example for covering moulds, tempering and press rings, glass transportation means etc. These fabrics are not very wear resistant, however, and result in less optical quality in the glass sheets thus moulded.

The use of knitted structures containing metal fibres is also known for this application. In the PCT patent application WO 94/01373 of applicant, for example, heterogeneously knitted fabrics are described, whether or not reinforced with an additional insert yarn, that is of the same type as the knitted yarn. This product deals with double bed knitted fabrics and the insert yarn is not incorporated with tuck stitches.

These conventional heavy knitted fabrics display the drawback that during use they sag down somewhat under their own weight. The causes of this are that the fibres lose a certain amount of strength at the high temperatures, and that each time the glass is pressed, the covering is subjected to a slight traction and a few metal fibres remain stuck on the glass sheet.

For the application under discussion in this example, however, it is of utmost importance that the knitted coverings always remain tightly fitted to the under or upper contact-forming support structure in order thus to avoid dimensional changes, defects in the glass, and obstructions of the production line in the glass forming process.

As a concrete example of a weft-knittted textile structure according to the invention that can be utilized for the application in view here, a circular knitted structure was made out of stainless steel of the AISI type 316L, reinforced with a multifilament Bekinox® VN continuous yam having a titre of 110 Tex, and comprising 90 filaments with an average equivalent diameter van 14 $\mu$m. The weight of this knitted textile structure is 1685 g/m$^2$. Its air permeability is 540 L/min/dm$^2$, at a pressure drop of 100 Pa. The portion of weight of the textile structure comprised by the multifilament insert yarn is 32%.

Through the utilization of a thinner insert yarn, the weight of the knitted fabric itself is smaller, so that the knitted fabric will sag less or not at all.

The utilization of a thinner insert yarn makes it possible to produce knitted fabrics with smaller stitches and/or higher gauges, which results in better optical properties in the moulded glass sheets. Despite these smaller stitches, the knitted fabric nonetheless remains sufficiently air permeable.

Furthermore, knitted textile structures into which an insert yarn is incorporated have a larger width than textile structures without insert yam, which makes it possible to shape larger glass plates, in particular car windows or windshields, of very good optical quality.

What is claimed is:

1. A single-bed weft-knitted textile structure comprising stainless steel fibre bundles, characterized in that said textile structure further comprises a reinforcing multifilament insert yarn with a titre of less than 180 Tex being incorporated into the textile structure in a regular pattern with tuck stitches.

2. A textile structure according to claim 1, characterised in that the textile structure is flat or circular knitted.

3. A textile structure according to claim 1, in which the weight of the textile structure is between 600 and 2000 g/m$^2$.

4. Textile structure according to claim 1, in which the air permeability of the textile structure is more than 400 L/dm$^2$/min with a pressure drop of 100 Pa.

5. Textile structure according to claim 1, in which the fibre bundles comprise fibres with an equivalent diameter that is between 2 and 100 $\mu$m.

6. Textile structure according to claim 1, in which the metal fibre bundles comprise fibres with an equivalent diameter that is between 2 and 40 $\mu$m.

7. Textile structure according to claim 1, in which the multifilament yarn is composed on average of between 30 and 1500 filaments.

8. Textile structure according to claim 1, in which the insert yarn is a multifilament stainless steel yarn.

9. Textile structure according to claim 8, characterised in that the portion by weight of the insert yarn in the textile structure is less than 35%.

10. Textile structure according to claim 1, in which the insert yam is a glass fibre yarn.

11. Textile structure according to claim 10, characterised in that the portion by weight of the weft yarn in the textile structure is less than 25%.

12. The use of a textile structure according to claim 1 for covering moulds and tempering or press rings which are utilized in the process of forming glass plates, or for covering transportation means for glass plates during their forming process.

* * * * *